United States Patent [19]

Hansow

[11] 3,952,337

[45] Apr. 27, 1976

[54] WATER DEFLECTOR FOR BATHING FACILITIES

[76] Inventor: Carol S. Hansow, 3247 Impala Drive, Apt. 1, San Jose, Calif. 95117

[22] Filed: Mar. 13, 1974

[21] Appl. No.: 450,652

[52] U.S. Cl. ..... 4/148; 4/149; 4/153; 4/154

[51] Int. Cl.[2] ..... A47K 3/14; A47K 3/22

[58] Field of Search ..... 4/148, 146, 145, 154, 4/152, 153

[56] References Cited

UNITED STATES PATENTS

| | | | |
|---|---|---|---|
| 1,807,107 | 5/1931 | Sternbergh | 4/145 |
| 2,748,908 | 6/1956 | Jacobson et al. | 4/154 X |
| 3,050,742 | 8/1962 | Munson | 4/154 |
| 3,104,014 | 9/1963 | Piette | 4/154 X |
| 3,724,000 | 4/1973 | Eakman | 4/148 |
| 3,737,921 | 6/1973 | Baumrind | 4/148 |
| 3,808,610 | 5/1974 | Mortensen | 4/149 |

*Primary Examiner*—Henry K. Artis
*Attorney, Agent, or Firm*—Paul B. Fihe

[57] ABSTRACT

Disclosed herein is a water deflector for confining water in bathing facilities. A rib extends outwardly from a wall a distance meeting a downhill drain path for containment of fluid tending to escape from bathing facilities.

1 Claim, 5 Drawing Figures

Fig. 1
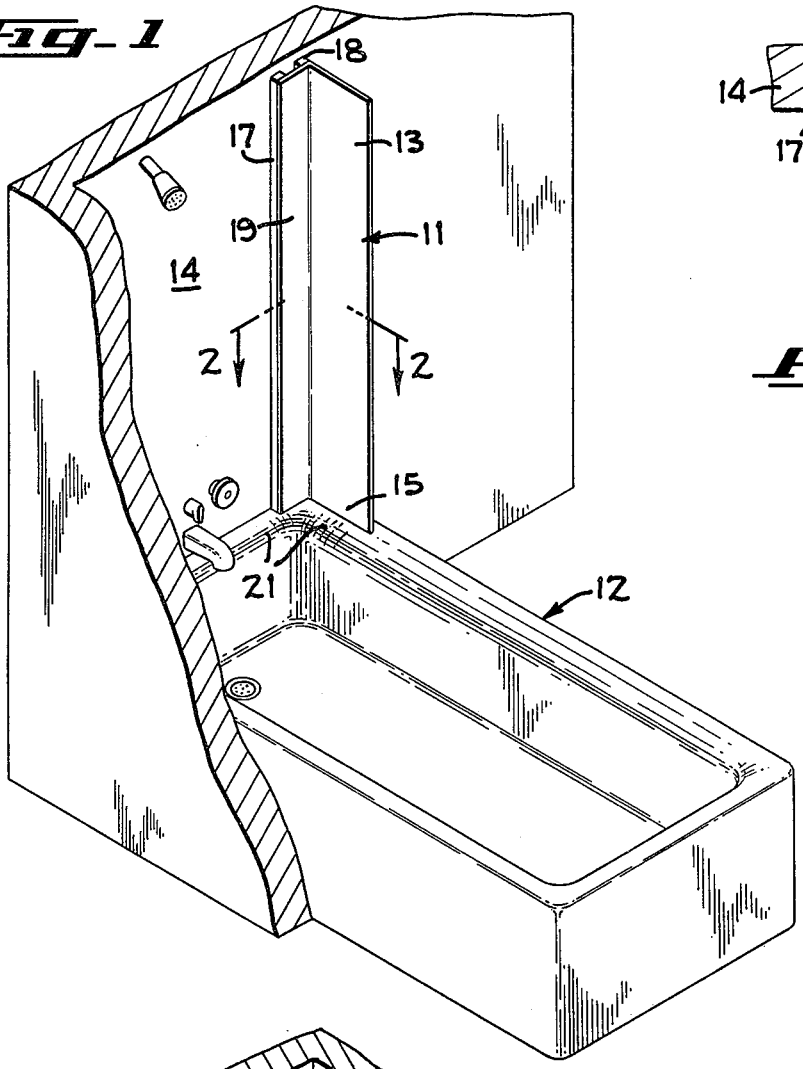
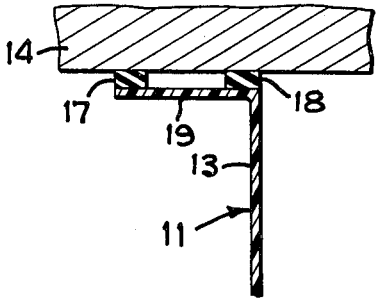
Fig. 2
Fig. 3
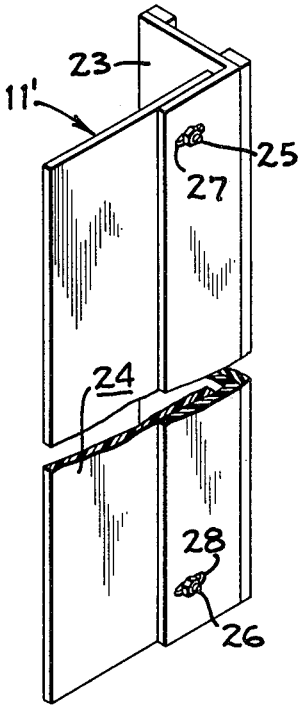
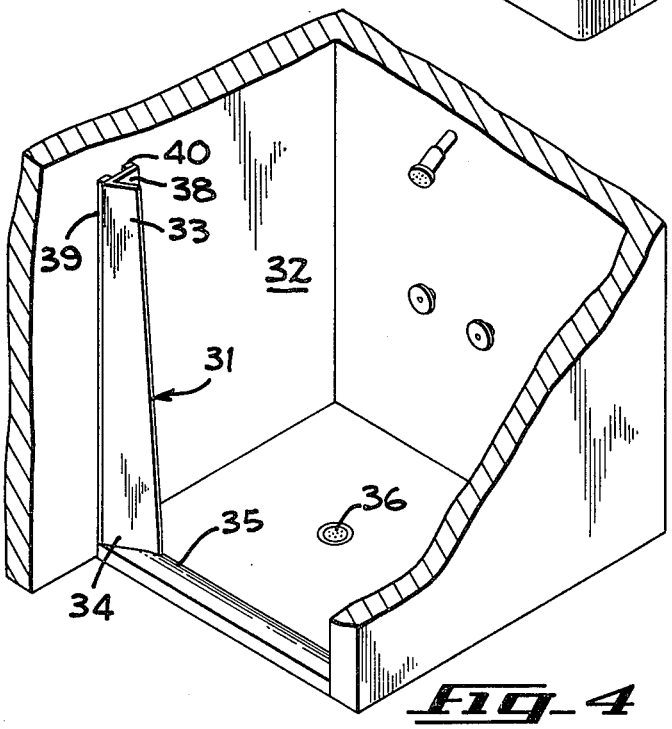
Fig. 4
Fig. 5
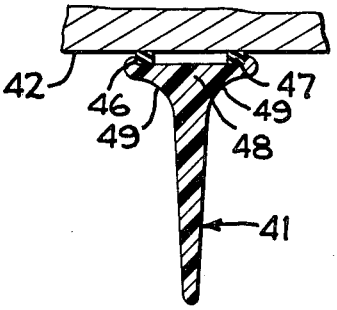

WATER DEFLECTOR FOR BATHING FACILITIES

BACKGROUND OF THE INVENTION

The invention relates to water deflectors and more particularly to a water deflecting rib adhesively fastened to a wall for establishing a boundary wall between wall portions which get wet and those which remain dry.

In most bathing facilities there is a tendancy for water, emanating from a pressurized source, to flow beyond the nearby confines of the area where drains are accessible. Since most urban water supplies provide water pressures of between 20–100 pounds, water spraying from showers and tubs has a kinetic energy sufficient to drive water droplets a considerable distance from their source. Water deflecting structures of the prior art such as tiles having outwardly curved sections often fail to do more than provide a slight obstruction in the path of escaping water. Alternatively, structures meant to be screwed or nailed to a wall often allow water to lodge behind the structure so that a certain amount to wall deterioration is inevitable.

SUMMARY OF THE INVENTION

Accordingly, the object of the present invention is to provide a hydrokinetic structure which adequately bounds wet and dry wall portions, which is easy to attach, and which prevents water from flowing behind the structure.

This object is achieved with a water deflecting rib which may be attached to a wall and which delivers deflected water to a downhill drain path thereby confining water to the immediate area of bathing facilities. More particularly, the rib includes body portions adapted for adhesive contact with a wall. An upright body portion projects outwardly at right angles from a wall but alternatively may project at an angle. In either case the lower end portion of the present water deflecting structure extends from the wall to a downhill drain path of the bathing facilities so that water tending to escape along the wall is intercepted by the present rib and is diverted toward a drain.

The adhesive contact feature of the body portions comprises longitudinally disposed impervious strips along the edges of the elongated rib upright body so that water cannot reside between the present structure and the wall to which it is attached. In alternate embodiments the water deflecting rib may comprise a single member projecting from a wall or a pair of intersecting planar members one of which includes adhesive fastening means for mounting both members to the wall. In both cases an upright body portion projects from a wall at a line defining wet and dry wall portions. Objects and features of the invention may be viewed in detail in the following figures.

BRIEF DESCRIPTION OF THE DRAWING

FIG. 1 is a perspective view of the water deflecting apparatus of the present invention installed near bathing facilities.

FIG. 2 is a section taken along line 2—2 in FIG. 1.

FIG. 3 is a rear perspective view of an alternate embodiment of the invention.

FIG. 4 is a perspective view of still another embodiment of the invention.

FIG. 5 is a cross-section of still another embodiment of the invention.

DESCRIPTION OF THE PREFERRED EMBODIMENTS

In FIG. 1, the water deflecting rib 11 is mounted in sealed relation to the bathing facility 12. The rib 11 includes a generally elongated body portion 13 projecting outwardly from a wall 14 and a lower end portion 15. The upright body portion 13 is adapted with adhesive means such as the strips 17 and 18 mounted near the edges of a support plate 19 connected to said upper body portion 13. Support plate 19 secures the main body portions in the desired position. Usually the support plate 19 is a unitary member of the rib 11. In FIG. 1 the support plate 19 is at right angles relative to the upright body portion 13. This angle is selected to meet a convenent drainpath. Where a right angle between the support plate 19 and the upright body portion 13 will not place the support plate in contact with a drain path, another more suitable angle should be selected.

Bathing facility 12 includes rounded portions 21 which form downhill drain paths for water. The lower end portion 15 of rib 11 extends outwardly from wall 14 up to a point of contact with the downhill drain path 21. In this way, water traveling along wall 14 toward rib 11 is intercepted by said rib. Water impelled outwardly along the lower body portion 15 flows to the outer extremity of the lower drain path which is in contact with the downhill drain path 21.

The adhesive strips 17 and 18 are elongated adhesive backed rubber strips which provide a slight elevation for the support plate 19. The strips 17 and 18 are disposed on opposite edges of the support plate 19 and are coextensive with the entire upright edges thereof, forming water impervious seals. Hence, water is prevented from flowing behind the rib 11 and its support plate 19 even when the wall 14 is extremely rough or rippled.

FIG. 2 shows a cross-sectional view taken along lines 2—2 of FIG. 1. In FIG. 2 the strips 17 and 18 are shown supporting the plate 19 at a spaced distance from the wall 14. The upright body portion 13 is shown extending outwardly from the plate 19 at approximately right angles thereto.

FIG. 3 shows a back view of an alternate embodiment of the apparatus of FIG. 1. In FIG. 3 the rib 11′ is shown to include a permanently fixed base mounted member 23 and a relatively slidable member 24 overlapping with the fixed member 23. A gasket along the edge of the fixed member 23 prevents water flow between members 23 and 24. The slidable member 24 is adjustable using the set screws 25 and 26 in the slots 27 and 28 respectively. It can be seen that the structure of FIG. 3 may be adapted to a wide variety of bathing facilities whose drain paths may be located in relatively different positions.

FIG. 4 shows another embodiment of the invention for use with shower type facilities. A rib 31 is shown to be projecting angularly from a wall 32. The rib 31 includes an upper body portion 33 and a lower body portion 34. Once again the lower body portion 34 has a length extending from a wall 32 to a downhill drain path 35, such as a ledge or step, directing water to the drain 36.

It will be noted that the lower body portion 34 projects outwardly from wall 34 a greater distance than the upper body portion 33. This feature reduces the possibility of a bather hitting the rib 31 when emerging from the bathing facility yet the rib has an ample lower body portion 34 for intercepting water and delivering it to a drain path. The rib 31 is adhesively mounted to wall 32 by means of the longitudinally coextensive support plate 38 having elongated adhesive strips 39 and 40 disposed on opposite edges of said base plate 38. Water given a sufficient kinetic energy tending to escape from the bathing facility will travel along the wall 32 until intercepted by the rib 31, whereupon the water will tend to flow downwardly to the base portion 34 and eventually be directed to a downhill drain path toward drain 36.

FIG. 5 shows still another embodiment of the invention especially suitable for extrusion. The rib 41 projects outwardly from a wall 42 and is adhesively mounted thereto. Two longitudinal strips 46 and 47 are proximate the opposite edges of the support portion 48 of rib 41 so that water is precluded from entering the region directly below the base. The curved section 49 of the base 48 is especially helpful in strengthening the support for rib 41 and is amenable to extrusion processes. The rib 41 would, of course, be curved toward a downhill drain path where necessary. Similarly, the rib 41 may be provided with an extension means such as the embodiment of FIG. 2 to reach the appropriate drain path.

Each of the water deflecting ribs shown in the Figures is preferably made of a resilient material such as plastic. Use of such resilient material precludes injury to persons who might inadvertantly come into contact with the rib. Additionally, when a translucent material is used the rib 11 becomes a decorative, yet functional, feature of the bathing facility.

In each of the embodiments the lower body portion of the water deflecting rib is grouted or sealed along its entire length relative to the respective bathing facility. Such grouting precludes entry of water behind the rib while simultaneously providing mechanical support. Accordingly, the rib bounds wet and dry wall portions, is easy to use and prevents water from flowing behind the structure.

What is claimed is:

1. A water deflecting rib for confining water in bathing facilities comprising, an upright body portion adapted for mounting on a wall, and including a fixed base member and a co-extensive member overlapping and slidably adjustable relative to said fixed base member so that said upright body portion may be extended to meet a selected drain path, and means inter-connecting said fixed base member and said adjustable member for holding said members in relatively adjusted positions.

* * * * *